US007793771B2

(12) United States Patent
Thues et al.

(10) Patent No.: US 7,793,771 B2
(45) Date of Patent: Sep. 14, 2010

(54) DEVICE FOR PUSHING METALLIC GOODS

(75) Inventors: Guenther Thues, Ratingen (DE); Frank Werner, Heiligenhaus (DE); Lothar Hanenberg, Düsseldorf (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 680 days.

(21) Appl. No.: 11/793,243

(22) PCT Filed: Dec. 13, 2005

(86) PCT No.: PCT/EP2005/013329

§ 371 (c)(1),
(2), (4) Date: Jun. 13, 2007

(87) PCT Pub. No.: WO2006/063778

PCT Pub. Date: Jun. 22, 2006

(65) Prior Publication Data

US 2008/0159836 A1 Jul. 3, 2008

(30) Foreign Application Priority Data

Dec. 15, 2004 (DE) ..... 10 2004 060 239

(51) Int. Cl.
*B21B 39/00* (2006.01)

(52) U.S. Cl. ..... 198/370.07; 198/370.01; 198/890

(58) Field of Classification Search ..... 198/890, 198/368, 370.1, 370.07
See application file for complete search history.

(56) References Cited

U.S. PATENT DOCUMENTS

| | | | | |
|---|---|---|---|---|
| 4,383,788 | A * | 5/1983 | Sylvander | 414/792.9 |
| 5,887,699 | A * | 3/1999 | Tharpe | 198/367 |
| 6,454,518 | B1 * | 9/2002 | Garcia-Balleza et al. | 414/801 |
| 6,708,385 | B1 * | 3/2004 | Lemelson | 29/563 |
| 6,804,931 | B2 * | 10/2004 | Pike | 53/252 |
| 6,845,860 | B1 * | 1/2005 | Walker | 198/433 |
| 7,000,755 | B2 * | 2/2006 | van Pinxteren et al. | 198/374 |
| 7,017,730 | B2 * | 3/2006 | Mills et al. | 198/368 |
| 7,309,203 | B2 * | 12/2007 | Clark et al. | 414/736 |
| 7,419,047 | B2 * | 9/2008 | Cesselli et al. | 198/597 |

OTHER PUBLICATIONS

Patent Abstract of Japan, No. JP 10263624, Oct. 6, 1998.

* cited by examiner

*Primary Examiner*—Douglas A Hess
(74) *Attorney, Agent, or Firm*—Abelman, Frayne & Schwab

(57) ABSTRACT

The invention relates to a device (1) for pushing metallic goods (2) off and onto a conveyor (3) in a direction (S) transverse to a conveying direction (F), wherein the device (1) has a displacement arm (5) displaceable relative to a stationary stand (4) and in an end region (6) of which, at least one gripping element (7, 8) is arranged for gripping the metallic goods (2). In order to be able to effect pushing of goods off of a conveyor and thereon in a simple and space-saving manner, the invention is characterized in that the displacement arm has at least two arm sections displaceable within each other in a telescopic manner.

4 Claims, 2 Drawing Sheets

DEVICE FOR PUSHING METALLIC GOODS

Figure 1:
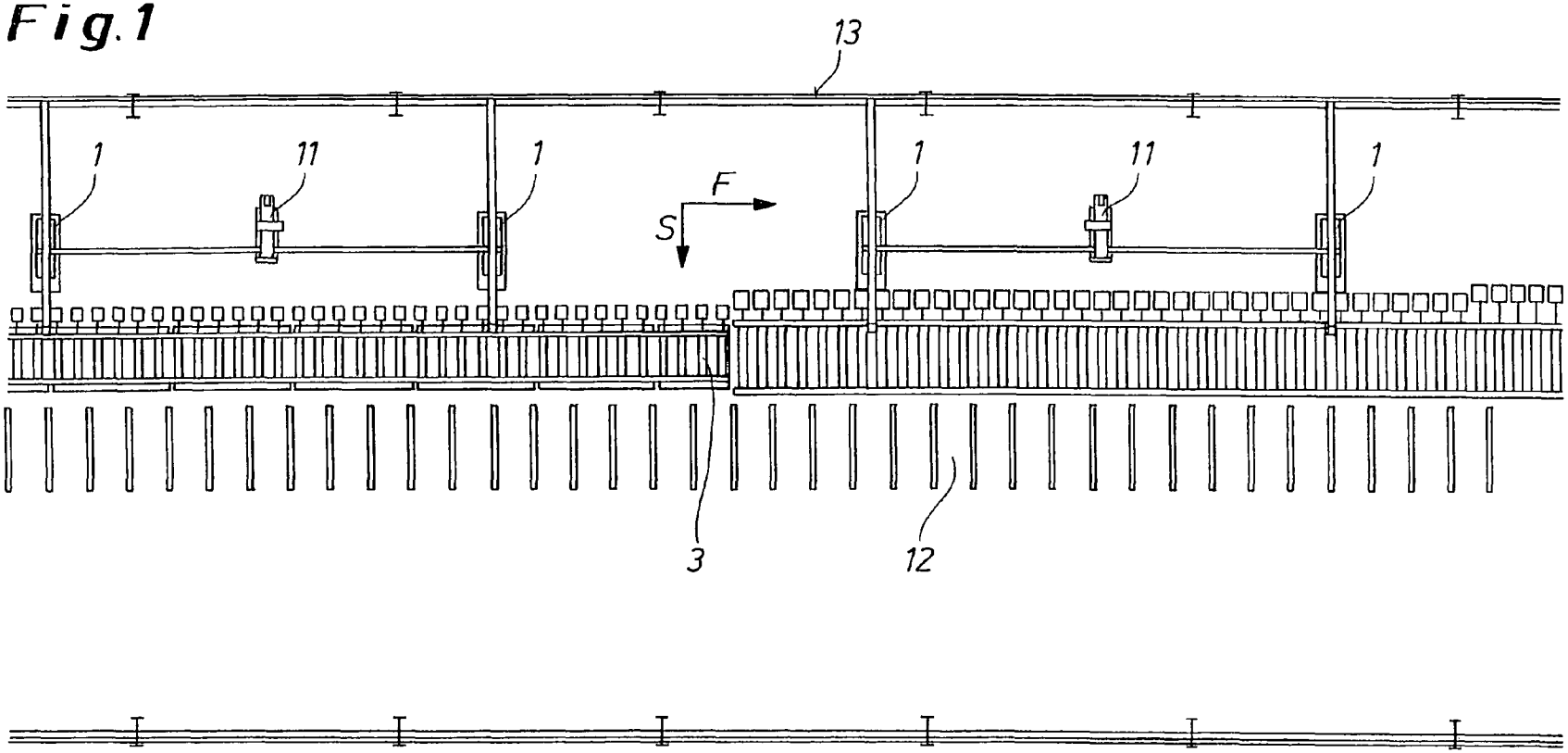

The invention relates to a device for pushing metallic good from or onto a conveyor in a direction transverse to a conveying direction, wherein the device has a displacement arm displaceable relative to a stationary stand and in an end region of which, at least one griping element is arranged for gripping the metallic goods.

In case of malfunction in a rolling mill, primarily, in a high-production rolling mill, a case can happen that a hot, heated for a rolling process, metallic stock (in particular slabs or strip blanks) that should be rolled up, must be kept on the rolling table (that is on the conveyor) until the malfunction is eliminated. If the stock cooled too much, it cannot be used further and rolled up. Rather, it should be removed as scrap. In order to be able to start the production again after elimination of the malfunction, the scrap strip should be removed from the roller table.

To this end, the above-mentioned device is used which can push the scrap in a horizontal direction transverse to the conveying direction of the roller table onto the storage console. Thus, it relates, e.g., to a strip blank pusher with which the scrap can be removed by pushing it off a pitch line. With such devices, the duration of the production stoppage can be reduced so that the economic efficiency of the rolling process is increased.

SU 1766548 A1 discloses a pusher with which metallic goods can be pushed transverse to the conveying direction of the roller table. The goods are pushed with a displacement arm displaceably supported in a rolling mill stand; on the displacement arm, finger-shaped gripping elements are arranged that can contact the goods. The device is relatively large in the direction transverse to the conveying direction of the roller table because the displacement arm must be displaced over a large width.

Similar solutions are disclosed in SU 1060265 A, SU 1036422 A and SU 582018 A. In all cases, there is provided a displacement arm that projects relatively far and that is displaceably supported in a housing for displacement transverse to the conveying direction. JP 10 263 624 A also proposes a similar device in which the finger-shaped gripping elements, when needed, can be displaced vertically downwardly. Here, likewise, the displacement arm projects relatively far in the direction transverse to the conveying direction. DE-OS 26 00 784 also describes the problem of rapid removal of portions of strip blank from a roller table, wherein particularities of constructive details of a strip blank pusher are not given.

Though with known devices for pushing metallic goods off or onto a roller table, the possibility exists to manipulate a scrap strip, still the known solutions present a problem when the existing installations must be retrofitted with such strip blank pushers. As a rule, the existing installations do not offer space relationships that would permit later to integrate a strip blank pusher of the known type as it requires an increased constructional space. Even the new installations have the drawbacks of the known installations as they also require relatively much space which is connected with corresponding costs.

A further drawback consists in that not all of the known devices permit to push the scrap goods which were pushed off the roller table, back onto the roller table. In many cases, the scrap strip an be pushed only sidewise of the roller table. Anyway, it is then necessary to cut the slabs or strip blanks, which cannot any more be rolled and which were pushed onto the storage console, manually with gas burners and transport them away. This is associated with increased costs and is, therefore, very expensive.

Therefore, it is desirable to have a device suitable for both pushing of scrap goods off the roller table and for pushing the scrap goods onto the roller table. Then, at a later time, the scrap can be transported away by the roller table, which has increased economical advantages.

Accordingly, an object of the invention, is a device of the type discussed above in which the above-mentioned drawbacks are eliminated. The pushers should require a substantially smaller space, without the functioning of the device being negatively influenced. In particular, both pushing of the scrap goods off the roller table and, if needed, pushing of goods onto the table should be possible.

This object is achieved by the invention which is characterized in that the displacement arm has at least two arm sections displaceable within each other in a telescopic manner.

According to further development, the arm sections have, in cross-section, a rectangular basic profile. Thereby, a high stability, in particular against torsion about the longitudinal axis of the arm, is achieved.

At least one of the gripping elements can be supported for rotation about an axis. The axis advantageously extends horizontally and faces in the conveying direction of the goods.

In order to enable both pushing of the scrap material off the roller table and also pushing back the material from a storage console onto the roller table in a simple manner, the device can be provided with two gripping elements one of which is arranged on the innermost, telescopically pushed in, arm section, and another is arranged on the arm section that directly receives the innermost, telescopically pushable-in arm section. Advantageously, it is further provided that the gripping element, which is arranged on the innermost telescopically pushable-in arm section, is supported for rotation about the above-mentioned axis. Further, according to this embodiment of the invention, the gripping element, which is arranged on the arm section that directly receives the innermost telescopically pushable-in arm section, is fixedly arranged on this arm section. Still, with this embodiment, it can be provided that the gripping element is so arranged and pivotable on the innermost telescopically pushable-in arm section that the innermost telescopically pushable-in arm section, together with the gripping element, can be pushed in the arm section that receives the innermost telescopically pushable-in arm section to a most possible extent, preferably, completely. Thereby, it is achieved in a particularly advantageous manner that the device part, which is provided for pushing back the scrap material from the storage console onto the roller table, in case it is not needed, is completely pushed into the arm and does not form any obstruction. Advantageously, there is further provided hydraulic piston-cylinder means for displacing the innermost telescopically pushable-in arm section relative to the arm section that directly receives the innermost telescopically pushable-in arm section.

It proved itself to arrange along the roller table several devices of the type described above in order to be able to push longer scrap strips. In this case, at least two such devices can be arranged along the conveyor with at least one arm section of arm sections being operated by a common drive device.

With the device proposed by the invention, it is possible to realize, in a particularly space-saving manner, a strip pusher that is suitable particularly good for rolling mills subjectable to retrofitting. With a smaller space requirement of the device, improved and more economical solutions are available even in new installations.

The drawings show an embodiment of the invention.

Figure 2:
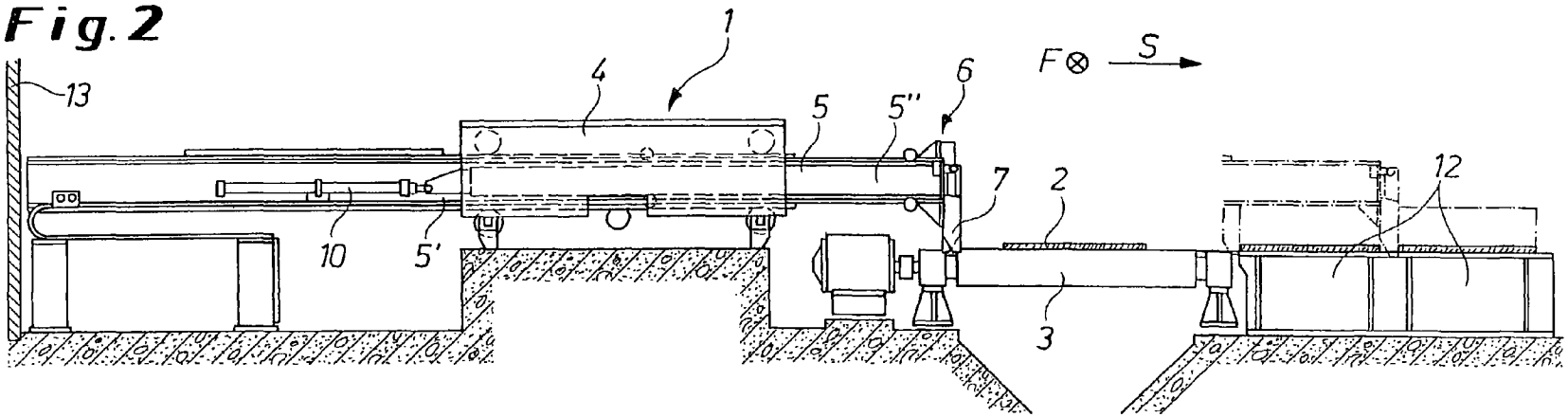
Figure 3:
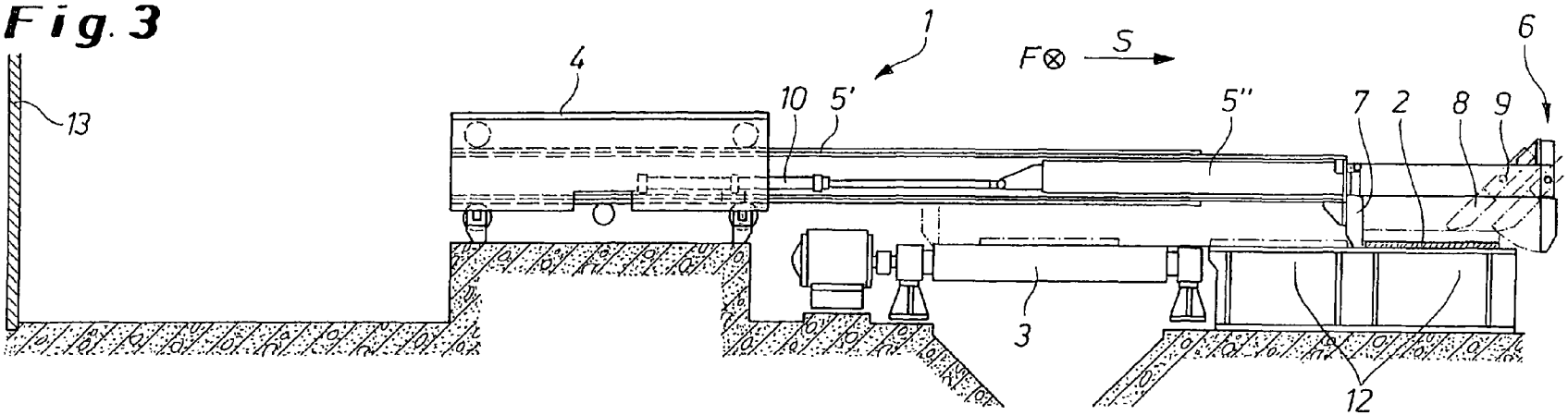

In the drawings:

FIG. 1 shows a plan view of a conveyor for slabs with peripheral parts;

FIG. 2 a side view of a device for displacing metallic goods during pushing the goods off the conveyor; and FIG. 3 a side view corresponding to that of FIG. 2 but during pushing of the goods back on to the conveyor.

It can be see in FIG. 1 that metallic goods can be conveyed along a conveyor 3 in form of roller table in a conveying direction F. If the rolling mill malfunctions and preheated rolling goods, which are delivered over the conveyor 3 to a rolling unit, not shown, cool too much, they should be disposed as scrap. In order to be able to remove the scrap material, so that the production process can be resumed after the elimination of the malfunction, there is arranged, sidewise, next to the conveyor 3, a storage console 12.

In the shown embodiment, four devices 1 for pushing the metallic goods are arranged along the conveyor 3. With the devices 1, the goods which are located on the conveyor 3, can be pushed in a horizontal direction S transverse to the conveying direction F both from the rolling table 3 onto the storage console and in the reversed direction, i.e., from the storage console onto the rolling table. The latter makes it possible to transport the scrap material over the roller table away when it is not needed for the production.

FIGS. 2-3 show the construction of the device 1. The device 1 includes a stationary stand 4 arranged sidewise of the rolling table 3. In the stand 4, a displacement arm 5, which is displaceable in a direction S, is arranged. In an end region 6 of the displacement arm 5, there is arranged in a gripping element 7 in form of a finger-shaped slider. As shown in FIG. 2, with the gripping element 7, metallic goods 2 are pushed off the rolling table 3 and onto the storage console 12. To this end, the displacement arm 5 is displaced, by a drive element, not shown, rightwards relative to the stand 4. After the displacement, the displacement arm 5 occupies a position shown sectionwise with dash-dote line in FIG. 2.

In order to keep the constructional space required for the device 1 as small as possible and to be able to retrofit the existing roll mills with the device 1, the displacement arm is formed of several parts. In the discussed embodiment, it has two arm sections 5', 5" displaceable telescopically within each other.

In FIG. 2, the two arms 5', 5" are shown as pushed into each other with solid lines (up to the non-visible parts which are shown with dash lines). As can be seen, a relatively little space is required that is limited by a brick wall 13. Nevertheless, a greater displacement path for goods 2 in the direction S can be realized, as it is apparent from the maximal end position of the displacement arm 5 (at the right in FIG. 2) shown with dash-dot lines.

In order to be able to push the goods 2 in the direction S off the roller table 3 onto the storage console 12 and, as in the case considered here, and to push the goods 2 back from the storage console 12 onto the roller table 3, it is provided, in this embodiment, that the arm section 5' has a gripping element 7 with which the goods 2 are pushed onto the storage console 12. For pushing the goods 2 back from the storage console 12 onto the roller table 3, there is provided a further gripping element 8 arranged at the end of the inner arm section 5'. To this end, reference is made to FIG. 3 that shows the displacement arm 5 in the maximal draw-out position.

Also can be seen that the gripping element 8 is supported for rotation about an axle 9, with the axle 9 being arranged horizontally and facing in the conveying direction F. Thereby, the gripping element 8 can, in case it is not needed, be pivoted into the horizontal position (the pivoted position of the gripping element 8 is shown in FIG. 3 with dash-dot lines). With a piston-cylinder system 10 arranged in the displacement arm 5, the innermost arm section 5", the innermost telescopic arm, can be pulled into the arm section 5' that directly receives it, until it is completely received there.

As can be seen in FIG. 1, a plurality, namely, two devices 1 can be driven by a common drive device 11, i.e., the displacement movement of the displacement arm 5 in the direction S is effected by the drive device 11. The observation of the displacement path of the displacement arm 5 or its sections 5', 5" can be carried out with linear or rotary sensors, not shown. The connection of the displacement arms 5 of separate devices 1 can be effected electrically mechanically, or hydraulically.

The device 1 is characterized in that in addition to the push-off of the goods 2 from the roller table 3 on the storage console 12, return push-off from the storage console 12 onto the roller table 3 is possible. To this end, the "pull-back arm" 5" is integrated into the "push-off" arm 5'. When the "push-back arm" 5" is not needed, it can be completely pulled back into the "push-off arm" 5'. The arm section 5" only then is pulled out when the scrap goods 2 should be pushed back form the storage console 12 onto the roller table 3.

It also can be provided that the finger-shaped gripped element 8 can be pivoted in a horizontal position (for pulling the arm section 5" into the arm section 5') by an actuator. For pivoting the gripping element 8 into an operational position for pulling of goods 2 from the storage console 12 onto the roller table 3, it can be provided that this takes place by the own weight of the gripping element 8, which takes place automatically when the arm 5" is pushed out by the piston-cylinder means 10 of the arm section 5'.

The guidance of the arm section 5" can be effected with movable therewith rollers arranged on or in the arm section 5'. Guidance with circular rods, slide bushes, or slide blocks is likewise possible.

With the device 1 it is possible to remove the scrap goods 2 completely automatically. To this end, the scrap goods (strip) 2 are pulled back from the storage console 12 onto the roller table 3 during rolling interval or during a planned break, and is transported by the roller table 3 to scrap processing (in the other part of the shop).

Thereby, the rolling time can be optimized with the device 1 which results in increase of production of a rolling mill.

LIST OF REFERENCE NUMERALS

1 Device for pushing metallic goods
2 Metallic goods
3 Conveyor
4 Stationary stand
5 Displacement arm
5"Arm section
5"Arm section
6 End region
7 Gripping element
8 Gripping element
9 Axis
10 Piston-cylinder means
11 Drive device
12 Storage console
13 Brick
F Conveying direction
S Direction transverse to the conveying direction

The invention claimed is:

1. A device (1) for pushing metallic goods (2) off or onto a conveyor (3) in a direction (S) transverse to a conveying direction (F), wherein the device (1) has a displacement arm (5) displaceable relative to a stationary stand (4) and in an end region (6) of which, at least one gripping element (7, 8) is arranged for gripping the metallic goods (2), characterized in that the displacement arm (5) has at least two arm sections (5', 5") displaceable within each other in a telescopic manner, and in that there are provided two gripping elements (7, 8) of which one is arranged on an innermost, telescopically pushed in, arm section (5") of the at least two arm sections, and another is arranged on an arm section (5') of the at least two arm sections that directly receives the innermost, telescopically pushable-in arm section (5").

2. A device according to claim 1, characterized in that the gripping element (8), which is arranged on the innermost telescopically pushable-in arm section (5") is supported for rotation about the axis (9), and in that the gripping element (7), which is arranged on the arm section (5') that directly receives the innermost telescopically pushable-in arm section (5"), is fixedly arranged on this arm section (5').

3. A device according to claim 1, characterized in that the gripping element (8) is so arranged and pivotable on the innermost telescopically pushable-in arm section (5") that the innermost telescopically pushable-in arm section (5"), together with the gripping element (8) can be pushed in the arm section (5') that receives the innermost telescopically pushable-in arm section (5"), to a most possible extent, completely.

4. A device according to-claim 1, characterized in that the device further comprises:

hydraulic piston-cylinder means (10) for displacing the innermost telescopically pushable-in arm section (5") relative to the arm section (5") that directly receives the innermost telescopically pushable-in arm section (5").

* * * * *